United States Patent [19]

Fujiwara

[11] Patent Number: 4,758,104

[45] Date of Patent: Jul. 19, 1988

[54] PRINTING DEVICE

[75] Inventor: Takashi Fujiwara, Ohbu, Japan

[73] Assignee: Brother Kogyo Kabushiki Kaisha, Aichi, Japan

[21] Appl. No.: 946,678

[22] Filed: Dec. 29, 1986

Related U.S. Application Data

[63] Continuation of Ser. No. 749,397, Jun. 27, 1985, abandoned.

[30] Foreign Application Priority Data

Jul. 6, 1984 [JP] Japan ..... 59-141056
Jul. 6, 1984 [JP] Japan ..... 59-141057

[51] Int. Cl.[4] ..... B41J 1/30

[52] U.S. Cl. ..... 400/144.2; 400/303; 400/322

[58] Field of Search ..... 400/144.2, 303-305, 400/903, 320, 322, 328

[56] References Cited

U.S. PATENT DOCUMENTS

| | | | |
|---|---|---|---|
| 3,700,807 | 10/1972 | Drapeau | 400/903 X |
| 4,114,750 | 9/1978 | Baeck et al. | 400/903 X |
| 4,145,644 | 3/1979 | Liu | 400/303 X |
| 4,189,246 | 2/1980 | Kane et al. | 400/51 |
| 4,311,398 | 1/1982 | Gerjets | 400/697 X |
| 4,444,519 | 4/1984 | Howell et al. | 400/144.2 X |
| 4,502,800 | 3/1985 | Jamieson et al. | 400/144.2 |

FOREIGN PATENT DOCUMENTS

| | | | |
|---|---|---|---|
| 220764 | 12/1983 | Japan | 400/303 |
| 176073 | 10/1984 | Japan | 400/303 |
| 201865 | 11/1984 | Japan | 400/304 |
| 2131747 | 6/1984 | United Kingdom | 400/304 |

*Primary Examiner*—William Pieprz
*Attorney, Agent, or Firm*—Parkhurst & Oliff

[57] ABSTRACT

The present invention relates to a printing device having a carriage and a serial-impact printing unit carried by the carriage, wherein characters are printed on a recording medium by the printing unit after the carriage has been moved to and positioned at predetermined printing positions in a printing direction. The printing device has a judging device for checking if the printing device is placed in a precise-positioning mode which is selected when relatively high positioning accuracy of the carriage is required, or in a normal-positioning mode which is selected when there is a relatively wide range of positioning tolerance of the carriage; and a switching device, responsive to the judging device, for effecting a printing operation at a comparatively low printing speed when the judging device has judged that the printing device is placed in the precise-positioning mode, and for effecting the printing operation at a comparatively high printing speed when the judging device has judged that the printing device is placed in the normal-positioning mode.

13 Claims, 4 Drawing Sheets

PRINTING DEVICE

This is a continuation of application Ser. No. 749,397 filed Jun. 27, 1985, now abandoned.

BACKGROUND OF THE INVENTION

1. Field of the Art

The present invention relates to a serial-impact printing device having character fonts or type elements, for example on a daisy type wheel, wherein a carriage which carries printing means, including such a type wheel, is moved along a line of printing to bring a desired character into a predetermined printing position. The positioned character is impacted subsequently on a recording medium, whereby successive characters are printed, one character at a time.

2. Related Art Statement

Such a serial-impact printing device is versatile, in that it may be used as a printer for printing data which is transferred from an external input device via an input connector, and also as a typewriter for printing data while the data is entered through a keyboard connected thereto. In either case, the printer is operated in a normal printing mode or in a special printing mode. In the normal printing mode, the characters are printed in a normal fashion-by means of intermittent movements of the carriage to successive printing positions. In the special printing mode, the characters are boldface-printed or shadow-printed for accentuation, or vertical lines are scored as for tabulation.

This type of serial-impact printer starts a printing action only after the carriage has been positioned at the appropriate printing position, and therefore suffers difficulty in speeding the printing operation. More specifically described, when a character is printed at printing position "b" of FIG. 5, the carriage is moved from the preceding position "a" to the printing position "b" by a one-character spacing. As indicated by curves C1 and C2 in the figure, the carriage undergoes a transient vibrational movement around the printing position "b", whose amplitude is gradually reduced to zero, with a result of the carriage being finally positioned at the predetermined position "b". The printing means is inhibited from starting its printing action until the transient phenomenon is thoroughly removed, i.e., until a point of time "t4" is reached, whereat the impacting action against the sheet of paper is started by the printing means. Accordingly, the waiting time of the printing means reduces the printing efficiency or speed of the printer.

Various attempts have been made to speed up the printing speed, i.e., to increase the number of characters printable per unit time. An example of such attempts is disclosed in Japanese Patent Application which was laid open in 1983 under Publication No. 58-67484. In a serial printer proposed in this application, the rate of movement of the carriage and the actuation timing of the print hammer are variably controlled depending upon a distance of movement of the carriage.

When characters are printed on paper in a normal manner with intermittent movements of the carriage, the characters do not generally give an unpleasant impression or appearance to the readers, even though the characters are deviated from their normal printing positions by a distance less than one tenth of a character-to-character spacing. On the contrary, the readers are likely to feel displeased with boldfaced or shadowed characters or vertical scores even when the specially printed characters or vertical scores are deviated only a slight distance from their normal positions. Thus, even a small amount of deviation of the carriage from the predetermined positions will degrade the impression or appearance of the boldfaced or shadowed characters, or vertical lines, and thus lower the printing quality in the special printing mode.

In the case where the printing device is used as a typewriter, it is required to correct or erase sets of characters or words which have been erroneously entered and printed. If the characters to be corrected are deviated from their normal positions, it is impossible to achieve perfect erasure or neat correction or replacement of the characters. When the printing device is operated as a printer, characters are merely printed and the correction of the printed characters is not necessary and impossible. In this case, non-special, ordinary characters will not give an unpleasant impression on the readers, even if the printed characters are slightly deviated from their normal positions.

It will be understood that the length of waiting time of the printing means required for substantial removal of the transient vibrational movement of the carriage at each commanded printing position, will differ depending upon the specific printing modes, that is, whether the printing device is operated in the special-printing mode for effecting a special printing such as boldfaced printing, shadow printing and vertical scoring, and whether the printing device is operated in the typewriter mode or in the printer mode. Accordingly, the use of constant length of waiting time before starting the impacting action without regards to the specific printing modes will lower the overall printing efficiency or printing speed of the printing device.

SUMMARY OF THE INVENTION

It is therefore an object of the present invention to provide a printing device having a carriage and serial-impact printing means carried by the carriage, having an improved printing speed, without lowering the printing quality.

According to the invention, there is provided a printing device having a carriage and serial-impact printing means carried by the carriage, wherein characters are printed on a recording medium by the printing means after the carriage has been moved to and positioned at predetermined printing positions in a printing direction, the printing device comprising judging means and switching means. The judging means checks if the printing device is placed in a precise-positioning mode which is selected when relatively high positioning accuracy of the carriage is required, or in a normal-positioning mode which is selected when there is a relatively wide range of positioning tolereance of the carriage. The switching means, which is responsive to the judging means, operates to effect a printing operation at a comparatively low printing speed when the judging means has judged that the printing device is placed in the precise-positioning mode, and effect the printing operation at a comparatively high printing speed when the judging means has judged that the printing device is placed in the normal-positioning mode.

In the printing device of the present invention constructed as described above, the printing operation is effected at a comparatively low speed in the precise-positioning mode, and at a comparatively high speed in the normal-positioning mode. The precise-positioning mode is selected when it is required to position the carriage and a selected type font or element of the serial-impact printing means relatively accurately at the predetermined printing position at which the corresponding character is to be printed. The normal-positioning mode is selected when a slight amount of deviation of the carriage from the predetermined printing positions will not appreciably affect the printing quality, that is when there is a relatively wide range of positioning tolerance of the carriage. According to this arrangement of the invention, the overall printing speed is increased, without substantively sacrificing the printing quality.

The term "printing speed" used herein is interpreted to mean the number of characters printable per unit time, which is affected by the rate of movement of the carriage, and by the waiting time of the printing means after the carriage movement command is removed, and before the printing means starts an impacting action to print the selected character on the recording medium. Therefore, the printing speed is determined by the movement rate of the carriage and the waiting time of the printing means.

According to an advantageous embodiment of the invention, the judging means checks if the printing device is placed in a typewriter mode or in a printer mode. In the typewriter mode, the characters are printed and/or corrected while the characters are entered. In the printer mode, the characters are printed after the characters have been entered and/or edited. The judging means judges that the printing device is placed in the precise-positioning mode when the typewriter mode is selected, and judges that the printing device is placed in the normal-positioning mode when the printer mode is selected. It will be understood that the typewriter mode of printing requires relatively precise positioning of the carriage to assure perfect correction or erasure of the printed characters, while the printer mode of printing operation requires relatively low positioning accuracy of the carriage, as the printer mode does not allow the printed characters to be corrected.

According to another advantageous embodiment of the invention, the judging means checks if the printing device is placed in a special-printing mode or in a normal-printing mode. In the special-printing mode, the characters are printed in boldface or shadow fashion, or vertical lines are scored. In the normal-printing modes, the characters are normally printed. The judging means judges that the printing device is placed in the precise-positioning mode when the special-printing mode is selected, and judges that the printing device is placed in the normal-positioning mode when the normal-printing mode is selected. In this arrangement, the special printing is effected at a relatively low speed, while the normal printing is performed at a relatively high speed. Therefore, the overall printing speed is increased while maintaining the printing quality.

According to one aspect of the invention, the switching means determines, based on the currently selected precise- or normal-positioning mode, the length of the waiting time of the printing means between the end of each movement of the carriage to the corresponding predetermined position, and the start of printing of the corresponding character. More specifically, the switching means is adapted to set the waiting time to be comparatively long when the judging means has judged that the printing device is placed in the precise-positioning mode, and to set the waiting time to be comparatively short when the judging means has judged that the printing device is placed in the normal positioning mode.

According to another aspect of the invention, the switching means determines the rate of movement of the carriage, based on the currently selected positioning mode, precise- or normal-positioning mode. When the judging means has judged that the precise-positioning mode is selected, the switching means selects a comparatively low rate of movement of the carriage. When the normal-positioning mode is selected, the switching means selects a comparatively high rate of movement of the carriage.

It is appreciated that both the waiting time of the printing means and the movement rate of the carriage be controlled depending upon the currently selected positioning mode, as described above.

BRIEF DESCRIPTION OF THE DRAWING

The foregoing and other objects, features and advantages of the present invention will become more apparent from reading the following detailed description of a preferred embodiment of the invention, when considered in conjunction with the accompanying drawing, in which.

DETAILED DESCRIPTION OF THE PREFERRED EMBODIMENT

To further clarify the concept of the present invention, a preferred embodiment of the invention will be described in detail, referring to FIGS. 1–5 of the accompanying drawing.

Figure 1:
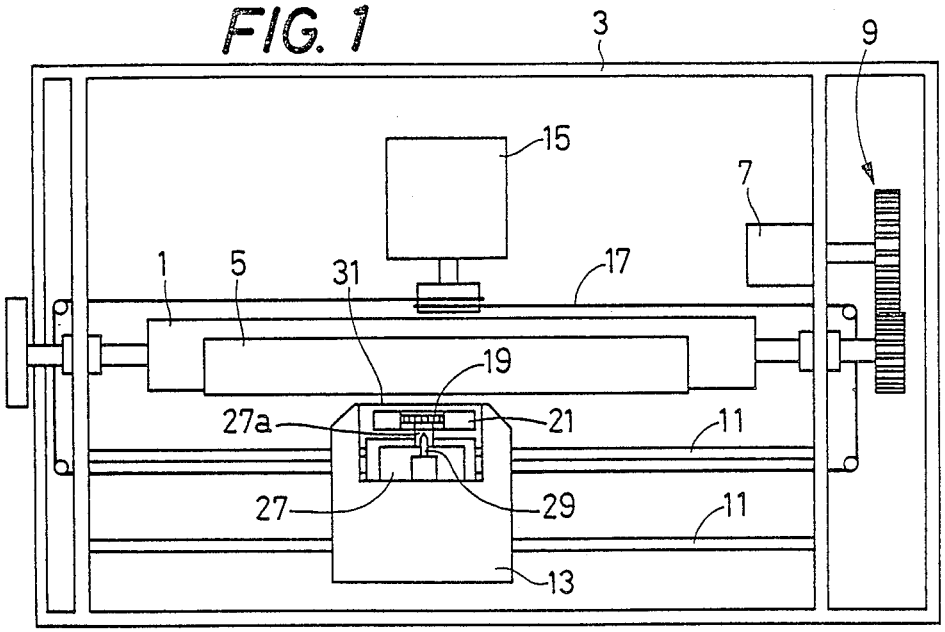
FIG. 1 is a schematic plan view of a printer section of a serial-impact printing device embodying the present invention.

There is schematically shown in FIG. 1 a printer section of a serial-impact printing device embodying the invention, wherein reference numeral 1 designates an elongate platen which is rotatably supported on a printer frame 3 to hold a recording medium in the form of a sheet of paper 5. The platen 1 is rotated by a paper feed motor 7 via a gear train 9 which connects the motor 7 and the platen 1. With the platen 1 rotated, the sheet of paper 5 is fed in a direction perpendicular to an axis of rotation of the platen 1, i.e., in a direction perpendicular to a line of printing on the paper 5.

A pair of spaced-apart parallel guide rods 11 are secured to the printer frame 3 so as to extend in parallel with the platen 1. The guide rods 11 support a carriage 13 so that the carriage 13 is slidably movable along the platen 1 in opposed relation with the sheet of paper 5. The carriage 13 is reciprocated by a carriage drive stepper motor 15 located behind the platen 1, via a wire 17 which transmits a rotary motion of the carriage drive motor 15 to the carriage 13.

Figure 2:
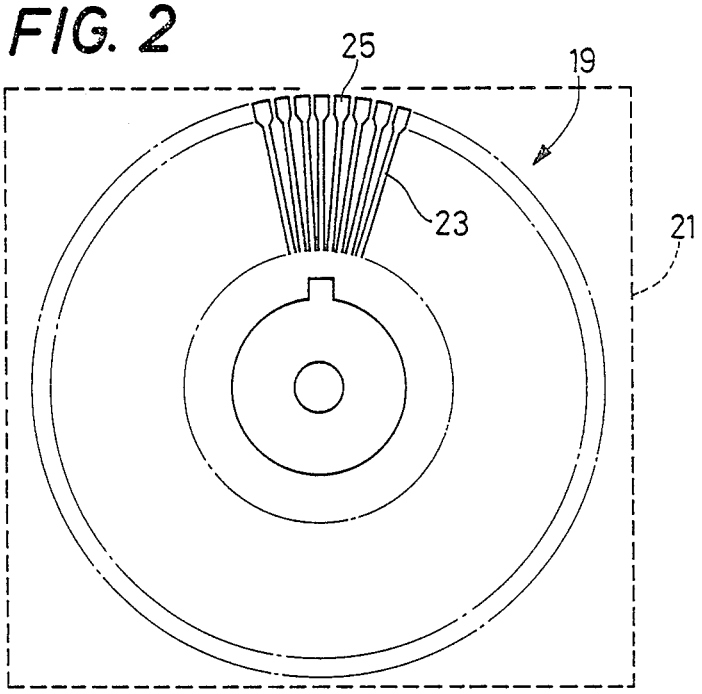
FIG. 2 is a schematic elevational illustration of a daisy type wheel used in the printer section of the printing device.

The carriage 13 carries a daisy type wheel 19 which is accommodated rotatably in a cartridge casing 21. As illustrated in FIG. 2, the type wheel 19 has a multiplicity of radial arms 23 which carry at their free ends multiple character fonts or type elements 25 which correspond to characters such as letters of a language or languages, numerals and various symbols. Thus, the type elements 25 are disposed along the outer circumference of the type wheel 19.

The daisy type wheel 19 is rotated by a wheel drive stepper motor 27 mounted on the carriage 13. The type wheel 19 is removably coupled to a rotor 27*a* of the stepper motor 27. Upon selection of a desired character, the type wheel 27 is indexed by the motor 27 by a suitable angle from a predetermined reference position, so that the corresponding type element 25 is brought into printing position.

The selected type element 25 which has been brought into the printing position by the wheel drive motor 27, is impacted by a print hammer 29 against the sheet of paper 5 via a ribbon 31, with an impact pressure suitable for the selected type element 25. The ribbon 31 is fed by a ribbon feed motor 33 (FIG. 3) between the selected type element 25 and the sheet of paper 5. Thus, the desired characters are printed in succession on the paper 5 along the line of printing parallel to the axis of the platen 1, while the carriage 13 is moved intermittently.

As is apparent from the foregoing description, the type wheel 19, wheel drive motor 27, print hammber 29, etc. constitute serial-impact printing means carried by the carriage 13 for printing the selected characters on the sheet of paper 5.

Figure 3:
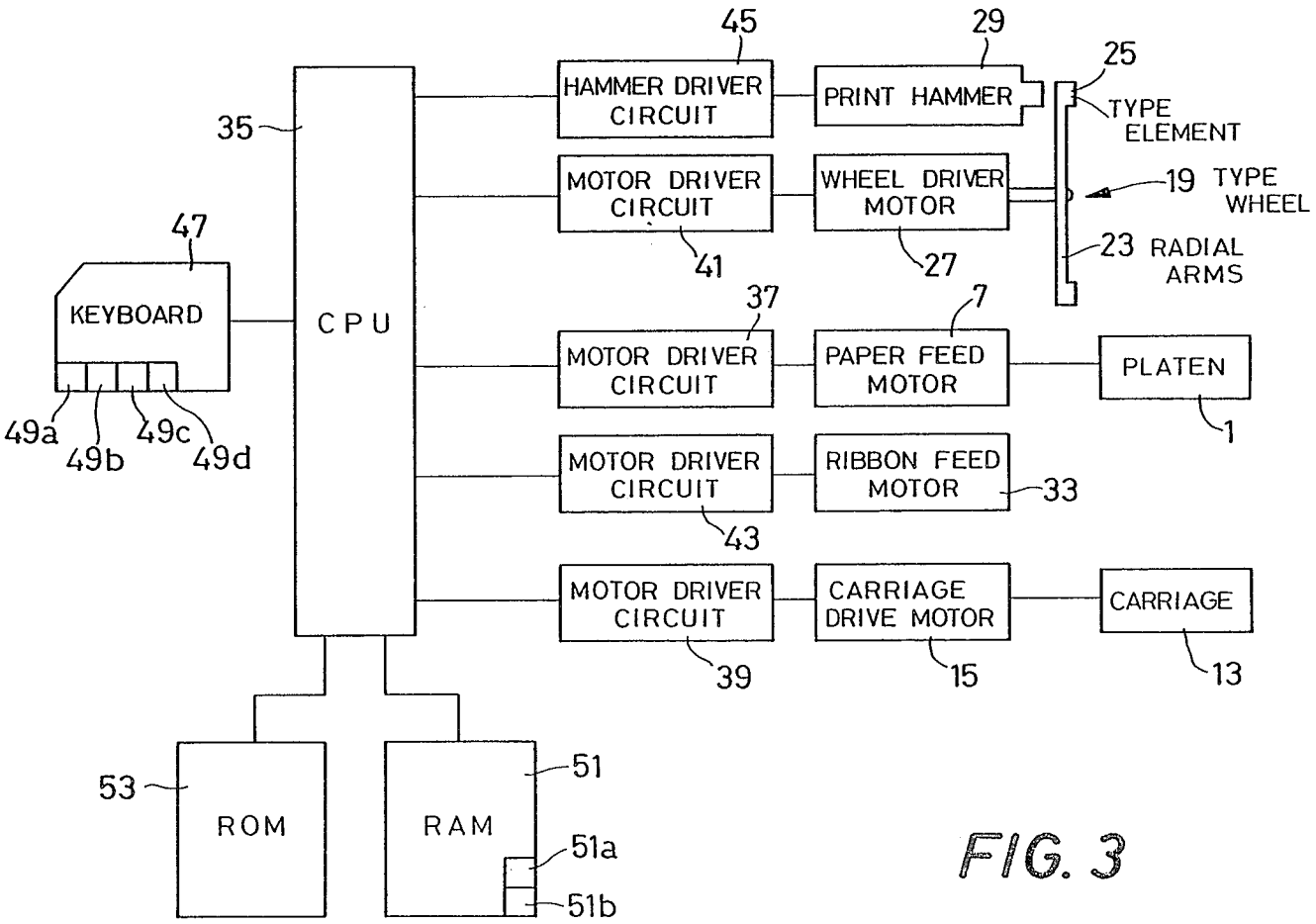
FIG. 3 is a block diagram showing an electrical arrangement of the printing device.

Referring to FIG. 3, the control system of the printing device uses a central processing unit 35 (hereinafter referred to as "CPU 35"). The previously described paper feed motor 7, carriage drive motor 15, wheel drive motor 27 and ribbon feed motor 33 are connected to motor driver circuits 37, 39, 41 and 43, respectively, while the print hammer 29 is connected to a hammer driver circuit 45. These driver circuits 37, 39, 41, 43 and 45 are connected to the CPU 35, so that the motors 7, 15, 27 and 33, and the print hammer 29 are controlled by the CPU 35 through the respective driver circuits 37, 39, 41, 43, 45.

The printing device is provided with a keyboard 47 connected to the CPU 35. The keyboard 47 has a multiplicity of character keys corresponding to the characters printed by the type elements 25, and various function keys which include a BOLDFACE key 49*a*, a SHADOW key 49*b*, a VERTICAL SCORE key 49*c* and a PRINTER/TYPEWRITER selector key 49*d*.

The BOLDFACE key 49*a* is used to effect a boldfaced printing in which the selected characters are printed in a boldfaced fashion. The SHADOW key 49*b* is used to effect a shadow printing in which the selected characters are printed by impacting the corresponding type elements 25 twice with the first and second impact positions being shifted a very small distance so that the two impressions overlap with each. The VERTICAL SCORE key 49*c* is turned on when vertical lines are scored.

The printing device is operable in one of two printing modes, PRINTER mode and TYPEWRITER mode, which are selected by the PRINTER/TYPEWRITER selector key 49*d*. In the PRINTER mode, the characters which have been already stored in a random-access memory 51 (hereinafter referred to as "RAM 51"), are printed in a continuous manner. In this mode, it is impossible to correct the printed characters. In the TYPEWRITER mode, the desired characters are printed and/or corrected while they are entered through the keyboard 47, as in an ordinary typewriter.

The above-indicated RAM 51, and a read-only memory 53 (hereinafter ROM 53) are connected to the CPU 35. The CPU 35 operates to process various signals, using the RAM 51 and the ROM 53.

Upon depression of the character keys on the keyboard 47, corresponding character signals are applied to the CPU 35. Furthermore, the CPU 35 receives BOLDFACE, SHADOW, VERTICAL SCORE and MODE signals, when the corresponding keys 49*a*, 49*b*, 49*c* and 49*d* are operated. The above-indicated signals from the keyboard 35 are coded by the CPU 35, and the coded signal is stored in the RAM 51. SPECIAL-PRINTING data indicative of the activation of the key 49*a*, 49*b*, 49*c* is stored at a bit 51*a*, while MODE data representative of the PRINTER or TYPEWRITER mode selected by the selector key 49*d* is stored at another bit 51*b*.

In the instant embodiment, the content of the bit 51*a* is "1" when any one of the BOLDFACE, SHADOW and VERTICAL SCORE keys 49*a*, 49*b*, 49*c* is activated. When none of these keys 49*a*, 49*b*, 49*c* are activated, the content of the bit 51*a* is "0". When the PRINTER/TYPEWRITER selector key 49*d* is set in the PRINTER mode position, the content of the bit 51*b* is "1". When the TYPEWRITER mode is selected by the selector key 49*d*, the content of the bit 51*b* is "0".

Based on the SPECIAL-PRINTING data and MODE data, i.e., on the current contents of the bits 51*a*, 51*b*, the CPU 35 judges whether the carriage 13 should be positioned at the predetermined printing positions with relatively high accuracy, or there is a relatively wide range of tolerances in positioning the carriage 13. In other words, the CPU 35 judges that the printing device is placed in a precise-positioning mode when the content of the bit 51*a* or 51*b* is "1", and judges that the printing device is in a normal-positioning mode when the content of the bit 51*a*, 51*b* is "0". Thus, the CPU 35 serves as judging means for checking if the printing device is currently placed in the precise-positioning mode or in the normal-positioning mode.

The ROM 53 stores programs for controlling the driver circuits 37, 39, 41, 43, 45. The following programs are similar to those used in a known serial-impact printer: program for operating the wheel drive motor 27 for indexing the type wheel 19 to bring the selected type element 25 into the predetermined printing position in front of the print hammer 29; program for operating the paper feed motor 7 to rotate the platen 1 in the clockwise and counterclockwise directions for feeding the sheet of paper 5; program for operating the ribbon feed motor 33 to feed the ribbon 31 past the selected type element 25; and program for driving the print hammer 29 to impact the selected type element 25 against the sheet of paper 5.

Figure 4:
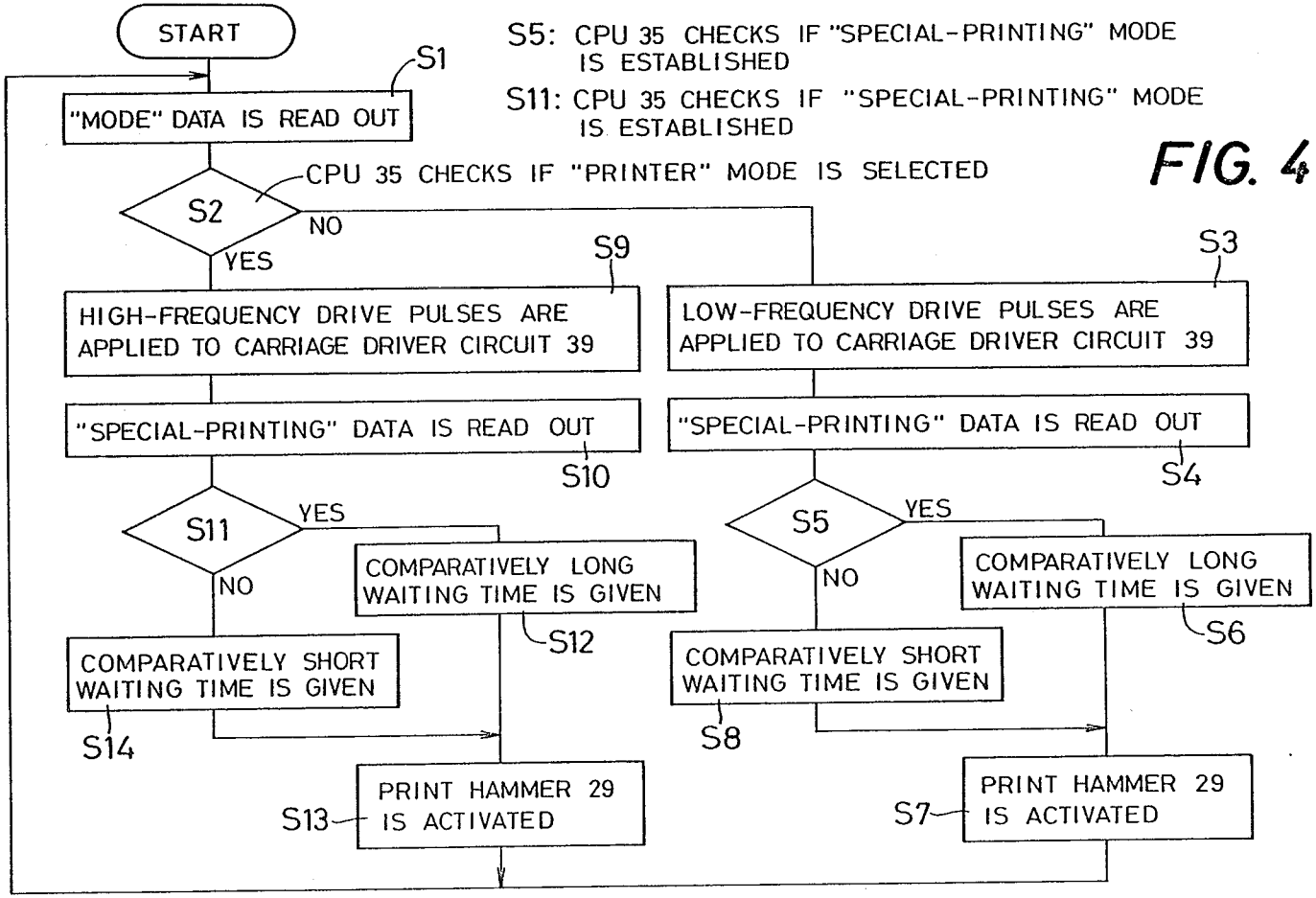
FIG. 4 is a flow chart illustrating the operation of the printing device.

Referring next to FIG. 4, the operation of the printing device constructed as described hitherto will be described. For easy understanding, steps of operation are indicated by step numbers following letter S.

Initially, the PRINTER/TYPEWRITER selector key 49*d* is set by the operator to select the PRINTER mode or TYPEWRITER mode. The MODE data representative of the currently selected mode is stored at the bit 51*b* in the RAM 51. The CPU 35 reads out the MODE data in step S1. In the case where the TYPEWRITER mode is selected, for example, the content "0" of the bit 51*b* is read out by the CPU 35. Based on the MODE data "0", the CPU 35 checks in step S2 whether the TYPEWRITER mode or the PRINTER mode is selected. If the MODE data is "0" and the TYPEWRITER mode is selected, the CPU 35 judges that the carriage 13 should be positioned with relatively high accuracy, and goes to step S3 to move the carriage 13 at a comparatively low speed. More specifically, step S3 is executed wherein low-frequency drive pulses are applied to the motor driver circuit 39 until the carriage 13 is moved to the commanded printing position. As a result, the carriage drive stepper motor 15 is operated to move the carriage 13 at the comparatively low rate, and is stopped so that the carriage 13 is positioned at the commanded position. The CPU 35 judges that the movement of the carriage 13 is stopped when the last drive pulse is applied to the driver circuit 39.

Figure 5:
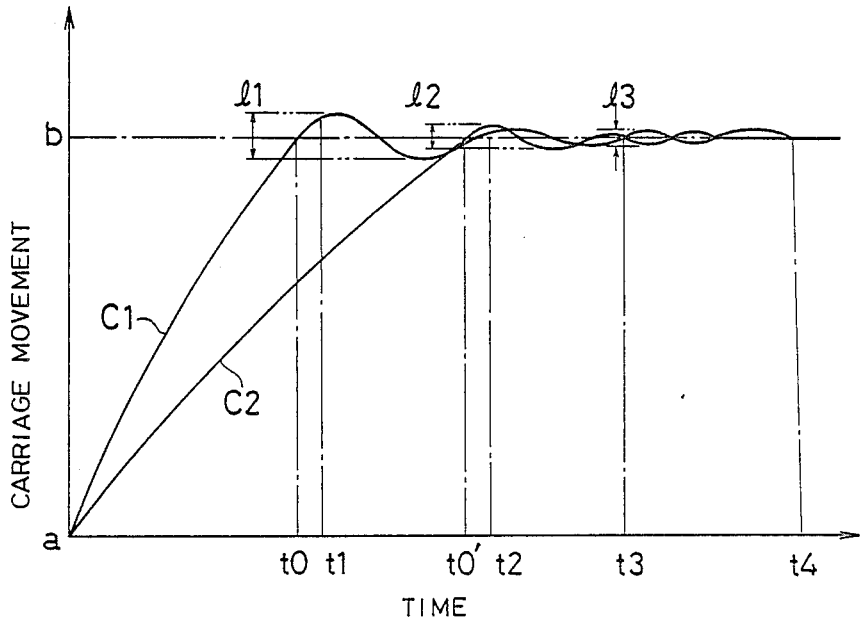
FIG. 5 is a graphical representation of carriage movements in relation to time.

A curve C2 of FIG. 5 indicates the movement of the carriage 13 in relation to time, when the carriage 13 is moved in step S3 in the TYPEWRITER mode (i.e., at a comparatively low rate). As shown in the figure, the carriage 13 undergoes a transient vibrational movement when the carriage movement is stopped at the predetermined or commanded position "b", at a point of time "t0'".

Then, the CPU 35 goes to step S4 to read out the SPECIAL-PRINTING data stored at the bit 51*a* in the RAM 51, and then to step S5 wherein the CPU 35 checks if any one of the BOLDFACE, SHADOW and VERTICAL SCORE keys 49*a*, 49*b*, 49*c* has been operated. This checking in step S5 is executed for determining whether a SPECIAL-PRINTING mode is established with the key 49*a*, 49*b*, 49*c* set in the ON position. If the SPECIAL-PRINTING mode is established, step S6 is performed to allow a comparatively long waiting time between the end of movement of the carriage 13 in step S3, and the start of activation of the print hammer 29 to impact the selected type element 25 in step S7 which will be described. Namely, if the BOLDFACE, SHADOW or VERTICAL SCORE key 49*a*, 49*b*, 49*c* has been depressed and the SPECIAL-PRINTING data "1" is stored at the bit 51*a*, the CPU 35 judges in step S5 that the printing device is placed in the SPECIAL-PRINTING mode. In this case, the CPU 35 goes to step S6 to allow a comparatively long time before the type element 25 is impacted, so that the amount of the transient vibrational movement of the carriage 13 is sufficiently reduced and the carriage 13 is positioned accurately at the commanded position "b". After the elapse of the predetermined comparatively long waiting time (between points "t0'" and "t4" of the curve C2 in FIG. 5), the CPU 35 goes to step S7 to apply a drive signal to the hammer driver circuit 45 to activate the print hammer 29, whereby the selected type element 25 of the type wheel 19 is impacted against the sheet of paper 5 via the ribbon 31 interposed between the type element 25 and the paper 5. Thus, the boldfaced or shadow printing or vertical scoring is started only after the carriage 13 and the type element 25 have been accurately positioned.

In the case where none of the keys 49*a*, 49*b*, 49*c* have been depressed and the SPECIAL-PRINTING data "0" is stored at the bit 51*a* of the RAM 51, the CPU 35 judges in step S5 that the SPECIAL-PRINTING mode is not established, and therefore goes to step S8 in which comparatively short waiting time is given before the print hammer 29 is activated in step S7. It is noted that the printing of characters in the normal printing mode does not require so high positioning accuracy of the carriage 13 as is required in the SPECIAL-PRINTING mode. Upon expiration of the predetermined comparatively short waiting time, the drive signal is applied in step S7 to the hammer driver circuit 45 to activate the print hammer 29. The type element 25 is impacted by the print hammer 29 at a point of time "t2" of the curve C2 in FIG. 5. In this case, the amount of deviation of the actual printing position from the predetermined position "b" due to the transient phenomenon of the carriage 13 is held within a permissible positioning tolerance l2. With the positioning deviation or error held within this range l2, the printed character may be corrected satisfactorily, that is, an erroneously entered character may be well erased and a desired character may be printed. Thus, the positioning error of the carriage 13 within the tolerance l2 will not result in degrading the printing quality to such extent that gives an unpleasant impression to the reader. Thus, the waiting time between "t0'" and "t2" in the normal printing mode is considerably shorter than the waiting time between "t0'" and "t4" in the SPECIAL-PRINTING mode, whereby the printing speed is accordingly increased.

Referring back to step S1, if the PRINTER mode is selected by the selector key 49*d* and the MODE data "1" is stored at the bit 51*b* in the RAM 51, the CPU 35 judges in step S2 that the PRINTER mode is selected. In this case, the CPU 35 goes to step S9 wherein high-frequency drive pulses are applied to the motor driver circuit 39 to operate the carriage drive motor 15 for moving the carriage 13 at a comparatively high speed, as indicated by a curve C1 in FIG. 5. In this connection, it is noted that the PRINTER mode of operation, which does not permit correction of printed characters, does not require so high positioning accuracy of the carriage 13 as is required in the TYPEWRITER mode.

Subsequently, the CPU 35 goes to step S10 similar to step S4, to read out the SPECIAL-PRINTING data at the bit 51*a*, and to step S11 similar to step S5, to check if the SPECIAL-PRINTING mode is established or not. If any one of the keys 49*a*, 49*b*, 49*c* has been operated and the SPECIAL-PRINTING data "1" is read out, the CPU 35 judges in step S11 that the SPECIAL-PRINTING mode is established. In this instance, the CPU 35 executes step S12 to give a comparatively long waiting time before the following step S13 is executed to activate the print hammer 29.

As soon as the predetermined comparatively long waiting time (between "t0" and "t3" of FIG. 5) has elapsed, the drive signal is applied to the hammer driver circuit 45 to activate the print hammer 29 and thereby impact the selected type element 25 against the paper 5. In this case, the amount of deviation of the actual printing position from the predetermined position "b" due to the transient phenomenon of the carriage 13 is held within a permissible positioning tolerance l3. With the positioning deviation or error held within this range l3, the printing in the SPECIAL-PRINTING mode may be accomplished with satisfactory printing quality. Namely, the positioning error of the carriage 13 within the tolerance l3 will not result in degrading the quality of the boldfaced or shadow printing or vertical scoring, to such extent that gives an unpleasant impression to the reader. The waiting time between "t0" and "t3" in the SPECIAL-PRINTING mode in the PRINTER mode is considerably shorter than the waiting time between "t0" and "t4" given in the conventional printer. Hence, the printing speed is accordingly increased.

If none of the keys 49a, 49b, 49c have been operated and the SPECIAL-PRINTING data "0" is read out in step S10, the CPU 35 judges that the SPECIAL-PRINTING mode is not established, and goes to step S14 to allow a comparatively short waiting time between "t0" and "t1" of the curve C1 of FIG. 5. That is, the drive signal is applied in step S13 to the hammer driver circuit 45 at point of time "t1" shortly after the carriage 13 has reached the predetermined position "b".

In this case, the amount of deviation of the actual printing position from the predetermined position "b" due to the transient phenomenon of the carriage 13 is held within a permissible positioning tolerance l1. With the positioning error held within this range l1, the normal printing in the PRINTER mode may be accomplished with satisfactory printing quality. Namely, the positioning error of the carriage 13 within the tolerance l1 will not result in degrading the printing quality to such extent that gives an unpleasant impression to the reader. Furthermore, the speed of the normal printing in the PRINTER mode is very much increased, since the activation of the print hammer 29 is effected at point "t1".

As discussed hitherto, the CPU 35 serves as judging means for checking if the printing device is placed in the PRINTER mode or in the TYPEWRITER mode, and for checking if the SPECIAL-PRINTING mode is established or not. These checking operations are carried out by reading the MODE and SPECIAL-PRINTING data stored in the RAM 51. In addition, the CPU 35 serves as switching means for selecting a comparatively low or high rate of movement of the carriage 13, based on whether the PRINTER or TYPEWRITER mode is selected. Further, the CPU 35 serves as switching means for selecting a comparatively long or short waiting time between the end of movement of the carriage 13 and the start of activation of the print hammer 29, based on whether the SPECIAL-PRINTING mode is established or not. In the TYPEWRITER mode and the SPECIAL-PRINTING mode, the carriage 13 should be positioned at the predetermined printing positions with relatively high accuracy, and therefore the carriage 13 is moved at a comparatively low speed and the print hammer 29 is activated a comparatively long length of time after the carriage 13 has been moved to the predetermined position. In the PRINTER mode, a permissible range of positioning error of the carriage 13 is relatively wide, and therefore the carriage 13 is moved at a comparatively high speed and the print hammer 13 is activated a comparatively short length of time after the end of movement of the carriage 13. Consequently, the overall printing speed of the printing device is increased, without lowering the printing quality even when the printed characters are corrected in the TYPEWRITER mode, or even when the special printing such as boldfaced or shadow printing or vertical scoring is effected.

While the present invention has been illustrated in its preferred embodiment, it is to be understood that the invention is not confined to the precise disclosure contained herein, but may be otherwise embodied with various changes which may occur to those skilled in the art.

In the illustrated embodiment, an open-loop control is employed for controlling the carriage drive stepper motor 15, and the CPU 35 judges that the movement of the carriage 13 is stepped at the time the last drive pulse is applied to the driver circuit 39. If a closed-loop control is used, however, the amplitude of the transient vibrational movement of the carriage 13 is reduced. Under some printing conditions (modes), therefore, it is possible to start the activation of the print hammer 29 immediately after the carriage 13 has been moved to the predetermined printing position. Namely, the comparatively short waiting time (between "t0'" and "t2", or "t0" and "t1" of FIG. 5) used in step S8 or S14 in the illustrated embodiment may be further reduced, so that the print hammer 29 is activated as soon as the carriage 13 has been moved to the predetermined position "b", if the closed-loop control is employed for the carriage drive stepper motor 15.

Although the rate of movement of the carriage 13 is selected based on whether the TYPEWRITER or PRINTER mode is selected, while the waiting time of the print hammer 29 is selected based on whether the SPECIAL-PRINTING mode is established or not, it is possible that the movement rate of the carriage 13 be selected depending upon the specific type of printing (normal printing, or special printing such as boldface or shadow printing), while the waiting time of the print hammer 29 be selected depending upon the currently selected mode of printing (typewriter mode or printer mode).

It will be obvious that other changes, modifications and improvements may be made in the invention without departing from the scope of the invention defined in the appended claims.

What is claimed is:

1. A printing device having a carriage and serial-impact printing means carried by the carriage, wherein characters are printed on a recording medium by the printing means after the carriage has been moved to and positioned at predetermined printing positions in a printing direction, comprising:

a typewriter mode wherein the characters are printed and/or corrected as the characters are being entered, an operation to correct the printed characters comprising erasing the printed characters by re-activating the printing means at the printing positions corresponding to said printed characters;

a printer mode wherein the characters are printed after the characters have been entered and/or edited;

a special-printing mode for effecting a special printing such as boldfaced printing, shadow printing and vertical scoring;

a normal-printing mode for printing the characters in a normal manner;

carriage control means operable for moving said carriage intermittently for positioning the carriage at said predetermined printing positions, said carriage control means providing a comparatively low rate and a comparatively high rate of movement of said carriage;

printing control means operable for controlling said serial-impact printing means, said printing control means providing a comparatively long waiting time and a comparatively short waiting time between arrival of said carriage at said predetermined positions and commencement of printing of the character;

judging means for checking if the printing device is placed in said typewriter mode or said printing mode, and for checking if the printing device is placed in said special-printing mode or said normal-printing mode; and switching means, responsive to said judging means, for selecting said comparatively low rate of movement of said carriage when said judging means has determined that the printing device is placed in said typewriter mode, and selecting said comparatively high rate of movement of said carriage when said judging means has determined that the printing device is placed in said printer mode, said switching means selecting said comparatively long waiting time when said judging means has determined that the printing device is placed in said special-printing mode, and said comparatively short waiting time when said judging means has determined that the printing device is placed in said normal-printing mode.

2. A printing device according to claim 1, further comprising a carriage drive motor supplied with drive power, and controlled by said carriage control means by means of an open-loop control circuit for moving said carriage, said switching means commencing measurement of said comparatively long and short waiting times when said drive power supplied to said carriage drive motor is cut off.

3. A printing device according to claim 2, wherein said carriage drive motor is a stepper motor.

4. A printing device according to claim 1, further comprising memory means including a first storage section for storing character data representative of said characters, a second storage section for storing mode data representative of currently selected one of said typewriter and printer modes, and a third storage section for storing special-printing data representative of one of said special-printing and normal-printing modes, said judging means checking, based on said mode data, if the printing device is placed in said typewriter mode or in said printer mode, and said judging means checking, based on said special-printing data, if the printing device is placed in said special-printing mode or in said normal-printing mode.

5. A printing device having a carriage and serial-impact printing means carried by the carriage, wherein characters are printed on a recording medium by the printing means a suitable period of time after the carriage has been moved to and stopped at predetermined printing positions in a printing direction, comprising:

carriage control means operable selectively in a high speed mode in which said carriage is moved at a comparatively high rate between each pair of adjacent two printing positions of said predetermined printing positions, or a low speed mode in which the carriage is moved at a comparatively low rate between each pair of said adjacent two printing positions of said predetermined printing positions, said carriage control means controlling said carriage to be moved to and stopped at each of said predetermined printing positions in both of said high speed and low speed modes;

printing control means for controlling said serial-impact printing means so as to operate selectively in a first mode in which said suitable period of time for printing of each character by said printing means is a comparatively long time after stopping of the carriage at each of said predetermined printing positions, or a second mode in which said suitable period of time for printing of each character by said printing means is a comparatively short time after the stopping of the carriage at each of said predetermined printing positions; and selector means for selecting one of said high speed and low speed modes of said carriage control means, and for selecting one of said first and second modes of said printing control means for the selected one of said high and low speed modes, said one of said high and low speed modes being selected independently of said one of said first and second modes.

6. A printing device according to claim 5, further comprising:

a typewriter mode wherein the characters are printed and/or corrected as the characters are being entered, an operation to correct the printed characters comprising erasing the printed characters by re-activating the printing means at the printing positions corresponding to said printed characters;

a printer mode wherein the characters are printed after the characters have been entered and/or edited;

judging means for checking whether the printing device is placed in said typewriter mode, or said printer mode; and switching means, responsive to said judging means, for operating said carriage control means in said low speed mode when said judging means has determined that the printing device is placed in said typewriter mode, said switching means operating said carriage control means in said high speed mode when said judging means has determined that the printing device is placed in said printer mode.

7. A printing device according to claim 6, further comprising:

a special-printing mode for effecting a special printing such as boldfaced printing, shadow printing and vertical scoring; and a normal-printing mode for printing the characters in a normal manner, and wherein said judging means checks whether the printing device is placed in said special-printing mode, or said normal-printing mode, said switching means selecting said first mode when said judging means has determined that the printing device is placed in said special-printing mode, said switching means selecting said second mode when said judging means has determined that the printing device is placed in said normal-printing mode.

8. A printing device according to claim 5, wherein the printing device is operated in a hydrid mode selected from two combined modes consisting of said low speed mode combined with said first mode and said high speed mode combined with said second mode.

9. A printing device according to claim 5, wherein the printing device is operated in a hybrid mode selected from three combined modes consisting of said low speed mode combined with said first mode, said low speed mode combined with said second mode, and said high speed mode combined with said second mode.

10. A printing device according to claim 5, wherein the printing device is operated in a hydrid mode selected from four combined modes consisting of said low speed mode combined with said first mode, said low speed mode combined with said second mode, said high speed mode combined with said first mode, and said high speed mode combined with said second mode.

11. A printing device having a carriage and serial-impact printing means carried by the carriage, wherein characters are printed on a recording medium by the printing means a suitable period of time after the carriage has been moved to and stopped at predetermined printing positions in a printing direction, comprising:

a special-printing mode for effecting a special printing such as boldfaced printing, shadow printing and vertical scoring;

a normal-printing mode for printing the characters in a normal manner;

printing control means operable for controlling said serial-impact printing means, said printing control means providing a comparatively long waiting time and a comparatively short waiting time between stopping of said carriage at each of said predetermined printing positions and commencement of printing of the corresponding character;

memory means for storing special-printing data representative of a currently selected one of said special-printing mode and said normal-printing mode;

judging means for checking, based on said special-printing data, if the printing device is placed in said special-printing mode or said normal-printing mode; and switching means, responsive to said judging means, for setting said suitable period of time by selecting said comparatively long waiting time when said judging means has determined that the printing device is placed in said special-printing mode, and by selecting said comparatively short waiting time when said judging means has determined that the printing device is placed in said normal-printing mode.

12. A printing device according to claim 11, further comprising manually-operated means for supplying said memory means with said special-printing data.

13. A printing device having a carriage and serial-impact printing means carried by the carriage, wherein characters are printed on a recording medium by the printing means a suitable period of time after the carriage has been moved to and stopped at predetermined printing positions in a printing direction, comprising:

a typewriter mode wherein the characters are printed and/or corrected as the characters are being entered, an operation to correct the printed characters comprising erasing the printed characters by re-activating the printing means at the printing positions corresponding to said printed characters;

a printer mode wherein the characters are printed after the characters have been entered and/or edited;

carriage control means for controlling said carriage to be moved to and stopped at each of said predetermined printing positions to sharpen outlines of said characters and improve positioning accuracy in both said typewriter and printer modes, said carriage control means providing a comparatively low speed and a comparatively high speed at which said carriage is moved between each pair of adjacent two printing positions of said predetermined printing positions;

memory means for storing mode data representative of a currently selected one of said typewriter mode and said printer mode;

judging means for checking, based on said mode data, whether the printing device is placed in said typewriter mode or said printer mode; and switching means, responsive to said judging means, for selecting said comparatively low speed when said judging means has determined that the printing device is placed in said typewriter mode, said switching means selecting said comparatively high speed when said judging means has determined that the printing device is placed in said printer mode.

* * * * *